US006209890B1

(12) United States Patent
Couderc

(10) Patent No.: US 6,209,890 B1
(45) Date of Patent: Apr. 3, 2001

(54) RETENTION DEVICE FOR A BOOT ON A GLIDE BOARD ADAPTED FOR SNOWBOARDING

(75) Inventor: Bernard Couderc, Annecy (FR)

(73) Assignee: Salomon S.A., Metz-Tessy (FR)

( * ) Notice: Subject to any disclaimer, the term of this patent is extended or adjusted under 35 U.S.C. 154(b) by 0 days.

(21) Appl. No.: 09/136,765

(22) Filed: Aug. 19, 1998

(30) Foreign Application Priority Data

Aug. 22, 1997 (FR) ..... 97 10775

(51) Int. Cl.[7] ..... A63C 9/081; A63C 9/20

(52) U.S. Cl. ..... 280/14.2; 280/618; 280/623; 280/633

(58) Field of Search ..... 280/14.2, 613, 280/623, 624, 625, 626, 617, 618, 633, 634

(56) References Cited

U.S. PATENT DOCUMENTS

| | | | | |
|---|---|---|---|---|
| 4,973,073 | | 11/1990 | Raines et al. | 280/624 |
| 5,261,689 | * | 11/1993 | Carpenter et al. | 280/14.2 |
| 5,299,823 | | 4/1994 | Glaser | 280/625 |
| 5,499,837 | * | 3/1996 | Hale et al. | 280/14.2 |
| 5,505,477 | | 4/1996 | Turner et al. | 280/613 |
| 5,520,406 | | 5/1996 | Anderson et al. | 280/624 |
| 5,667,237 | * | 9/1997 | Lauer | 280/14.2 |
| 5,690,351 | * | 11/1997 | Karol | 280/14.2 |
| 5,713,594 | * | 2/1998 | Jenni | 280/14.2 |
| 5,722,680 | * | 3/1998 | Dodge | 280/14.2 |
| 5,826,910 | * | 10/1998 | Ricks et al. | 280/14.2 |
| 5,855,390 | * | 1/1999 | Hassell | 280/14.2 |
| 5,890,730 | * | 4/1999 | Anderson et al. | 280/14.2 |
| 5,957,479 | * | 9/1999 | Bayer et al. | 280/14.2 |
| 6,007,085 | * | 12/1999 | Rigal et al. | 280/14.2 |
| 6,050,589 | | 4/2000 | Couderc et al. | 280/624 |

FOREIGN PATENT DOCUMENTS

| | | | | |
|---|---|---|---|---|
| 0752258 | | 1/1997 | (EP) . | |
| 0823268A1 | * | 2/1998 | (EP) | 280/14.2 |
| 0838250 | * | 4/1998 | (EP) | 280/14.2 |
| WO96/05894 | | 2/1996 | (WO) . | |
| WO97/18016 | | 5/1997 | (WO) . | |

* cited by examiner

*Primary Examiner*—Lanna Mai
*Assistant Examiner*—Jeff Restifo
(74) *Attorney, Agent, or Firm*—Greenblum & Bernstein P.L.C.

(57) ABSTRACT

A retention device for a boot on a glide board adapted for the practice of snowboarding. The device includes a base, a plate, a disk and at least one retention screw for the disk provided to be screwed into the board. The base has a rear support element, a retention mechanism affixed to tie plate retains the boot, and the device extends along a longitudinal direction which is the longitudinal direction of the boot when the latter is retained on the device. The device includes at least one translational guide mechanism for the plate with respect to the base along the longitudinal direction of the device.

25 Claims, 3 Drawing Sheets

RETENTION DEVICE FOR A BOOT ON A GLIDE BOARD ADAPTED FOR SNOWBOARDING

BACKGROUND OF THE INVENTION

1. Field of the Invention

The invention is related to the field of gliding sports, snowboarding in particular, and it is especially related to a device for retaining a boot on a glide board and, more particularly, on a snowboard.

2. Description of Background and Relevant Information

The sport of snowboarding is generally practiced with boots that are connected to a glide board via retention devices. When a user employs flexible boots that allow for easy walking, he has to use retention devices that enable rear support to be taken with the lower part of the leg, so that the board performs correctly.

Known retention devices generally comprise a base affixed to the board via a disk and screws. A rear support element whose position can be adjusted longitudinally with respect to the base allows the boot to be positioned on the device via heel contact, and attachment means retain the boot on the device in contact with the base and the rear support element.

These devices make the steering of the board possible, but they do have certain disadvantages. In particular, the adjustment of the position of the foot with respect to the board is time consuming and difficult to undertake, thus causing lost time. This problem is particularly vexing for businesses that rent out equipment, and who must quickly adjust a retention device according to the size of the boot. Another disadvantage is a lack of precision in the rear supports taken, due to the presence of a clearance between the boot and the rear support element.

SUMMARY OF THE INVENTION

An object of the invention is to resolve the problem of the time that it takes to adjust a retention device, as well as the problem of the clearance between the boot and the rear support element of the device.

In order to resolve these problems, the invention provides for a retention device for a boot on a glide board adapted for snowboarding, such device comprising a base, a plate, a disk and at least one retention screw for the disk provided to attach same to the board, the base having a rear support element provided to come into contact with the boot, a retention element affixed to the plate and enabling the boot to be retained on the device, the device extending along a longitudinal direction which is the longitudinal direction of the boot when the latter is retained on the device.

The device according to the invention includes at least one mechanism for the translational guidance of the plate with respect to the base along the longitudinal direction of the device. Consequently, the clearance between the boot and the rear support clement can be adjusted to a zero value so as to enable rear supports to be taken with precision.

Another specificity of the device is that the disk biases the plate and the base towards the board when the screw is screwed into the board, such that the plate and the base are immobilized simultaneously with respect to the board.

The retention screw or screws for the disk enable the device to be positioned on the board and the rear support clement to be kept in contact with the boot. An advantageous result thereof is that the time required for adjusting the device becomes very short when compared to a traditional device.

Preferably, the translational guide mechanism is obtained by the cooperation of at least one groove of the plate with at least one projecting ridge/lip of the base, the groove and the ridge being oriented parallel to the longitudinal direction of the device. Thus, it becomes possible to bring the rear support element closer to or further away from the boot with great ease.

The device according to the invention also comprises a positioning mechanism provided to translationally position the plate with respect to the base in the longitudinal direction.

Preferably, the positioning mechanism has a cursor that permanently biases the plate towards the base via a pinching effect.

Thus, it becomes possible to tighten the retention screws of the disk without any risk of upsetting the position of the base with respect to the plate. The presence of the positioning mechanism enables the position of the plate to be adjusted with respect to the base, before adjusting the position of the device on the board.

The disk preferably has a peripheral surface provided to position the plate with respect to the disk, the plate having a surface that is complementary to that of the disk.

Finally, according to a preferred embodiment of the invention, the retention element of the boot and the translational guide mechanism of the plate with respect to the base are arranged in the vicinity of a lateral edge of the device. This facilitates the putting on and removal of the boot.

The invention is also related to an assembly having a board and a retention device.

BRIEF DESCRIPTION OF DRAWINGS

Other characteristics and advantages of the invention will be better understood in light of the following description, and the annexed drawings that illustrate, in a non-restrictive embodiment, how the invention can be obtained, and wherein.

DETAILED DESCRIPTION OF THE INVENTION

A preferred embodiment of the invention is described with the reference to FIGS. 1 through 5.

Figure 1:
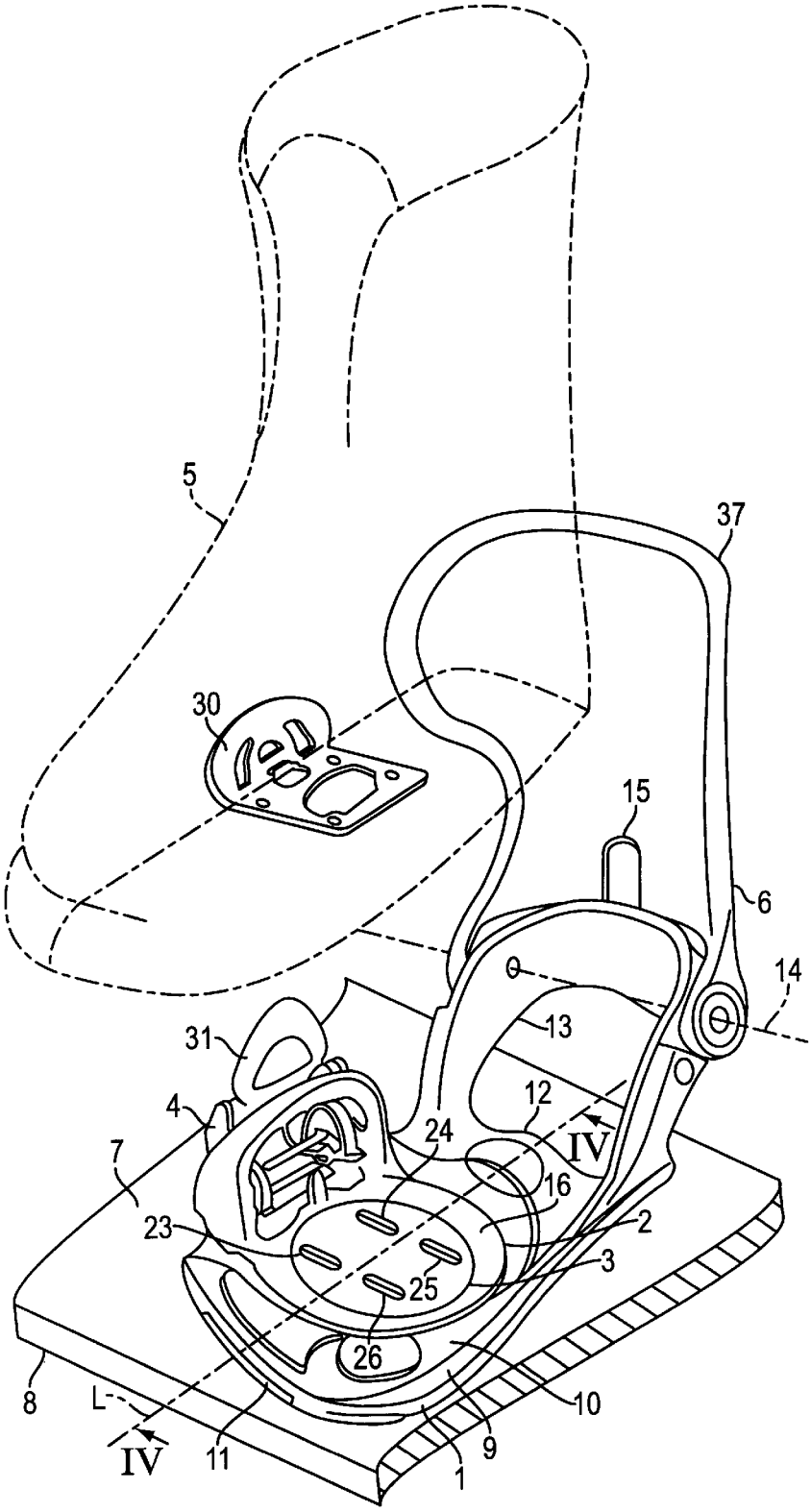
FIG. 1 is an exploded perspective view of an assembly having a boot, a retention device according to the invention, and a glide board.

The retention device according to the invention, illustrated for example, in FIG. 1, has a base 1, a plate 2, a disk 3, a retention mechanism 4 for a boot 5, as well as a rear support element 6.

The device is placed on a support surface 7 of a board 8 by placing a lower surface 9 of the base 1 in contact with the support surface 7, the lower surface 9 being substantially parallel to a support surface 10 of the base 1 opposite the surface 9 with respect to the thickness of the base 1. The retention device extends along a longitudinal direction L passing through a front end 11 and a rear end 12 of the base 1. A rear edge 13 of the rear support element 6, in the form of a projecting arc with respect to the surface 10, extends the base 1 towards the rear, the edge 13 being provided to wedge the heel of the boot 5. The rear support element 6 has a collar 37, journalled along a substantially transverse axis 14 of the device with respect to the edge 13, that extends the device away from the surface 10 so as to come into contact with the upper of the boot 5 at the rear of the lower part of a user's leg. Thus, the entire rear portion of the boot 5 is in contact with the device when it is being used. The journal along the axis 14 advantageously enables the collar 37 to be folded back from the rear support element 6 towards the surface 10 so as to facilitate storage.

A stop element 15, represented in the form of an abutment, limits the rotation of the collar 37 towards the rear, so that the user can take support with the lower part of the leg.

The support surface 10, as well as a support surface 16 of the plate 2, are provided to receive the sole of the boot 5.

Figure 4:
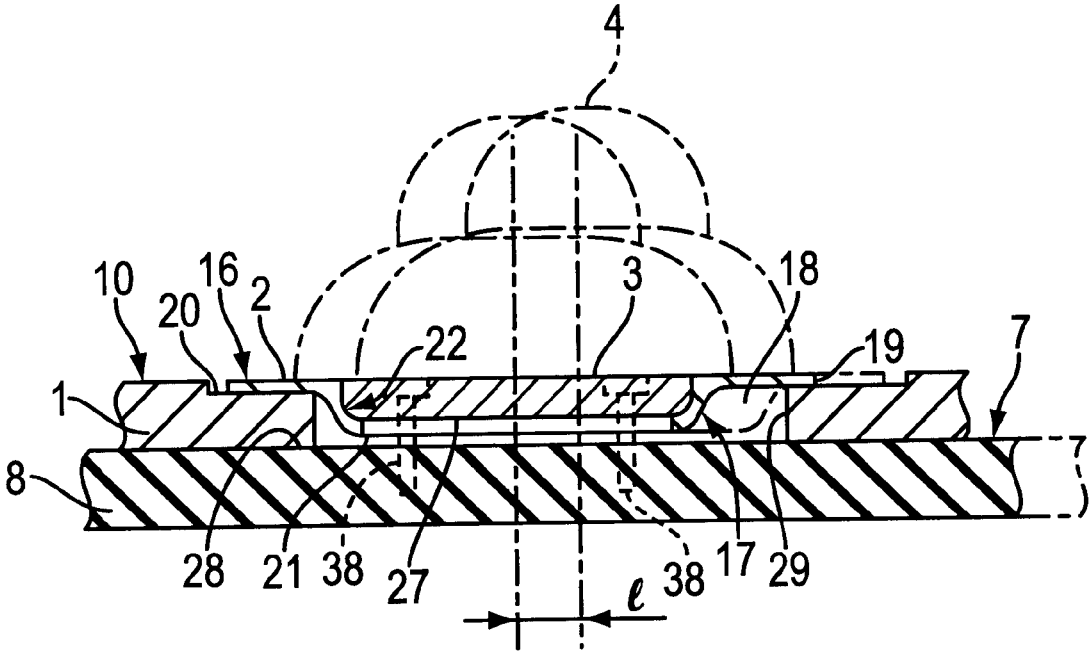
FIG. 4 is a cross-section taken along the line IV—IV of FIG. 1.

For this reason, as is clearer from FIG. 4, the support surface 10 of the base 1 and the support surface 16 of the plate 2 arc located substantially in a common plane. The plate 2 has a boss 17 that is housed in an oblong opening 18 of the base 1. The plate 2 has a edge portion or lip 19 that takes support on a recessed portion 20 of the surface 10. The thicknesses of the base 1 and the plate 2 are provided in such a way that a space 21 remains between the boss 17 and the surface 7 of the board 8.

In a known manner, the disk 3 is seated in an upward open recess 22 of the plate 2, the respective shapes of the disk 3 and the opening 22 enabling the disk 3 to bias the plate 2 towards the board 8 when affected by a tightening device of the disk 3. An example of the tightening device of the disk 3 includes the use of four screws 38, or shown in FIGS. 3 and 4, that are screwed into the board 8 through four oblong holes 23, 24, 25, 26 of the disk 3, shown, for example, in FIG. 1. As can be seen from FIG. 4, the screws 38 also cross an opening 27 of the plate 2 as well as the opening 18 of the base 1.

When the tightening screws of the disk 3 arc loosened, it becomes possible, in a known manner, to adjust the position of plate 2 with respect to the board 8. When the tightening screws of the disk 3 are loosened, it also becomes possible to displace the base 1 with respect to the plate 2 along the longitudinal direction L of the device.

Figure 2:
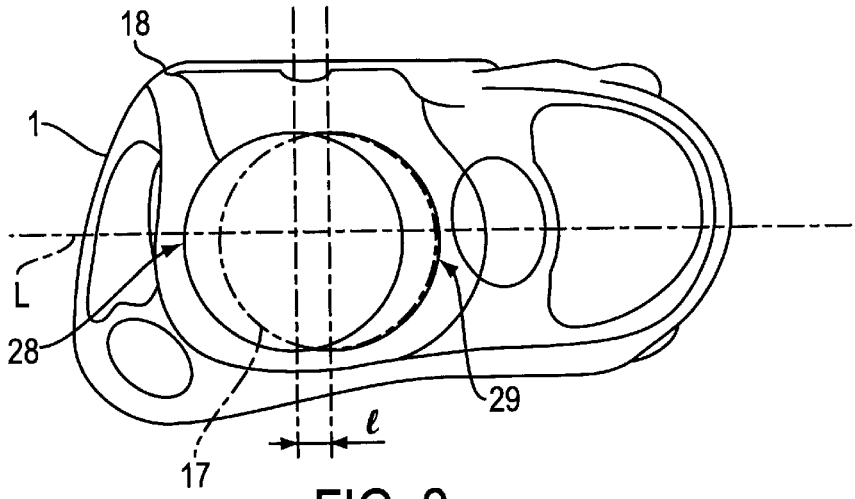
FIG. 2 is a partial top view of the device and illustrates a relative displacement between the component elements of the retention device.

Indeed, as can be seen from the example of FIG. 2, the oblong opening 18 of the base 1 allows the boss 17 of the plate 2 to be displaced along the longitudinal direction L between a front end 28 and a rear end 29 of the oblong opening 18. The amplitude of the displacements is represented by the value 8. As can be understood on the basis of FIG. 4, when the tightening screws of the disk 3 are tightened, the disk 3 biases the plate 2 towards the board 8, and the plate 2 biases the base 1 towards the board 8 by support on the strip 19 along a portion 20 of the surface 10. Consequently, the tightening of the screws simultaneously immobilizes the disk 3, the plate 2 and the base 1 with respect to the board 8. By means of the cooperation between the disk and both the plate 2 and the base 1, the disk can be regarded as a tightening device for the plate and base. The advantages resulting from this characteristic are explained hereafter.

Figure 3:
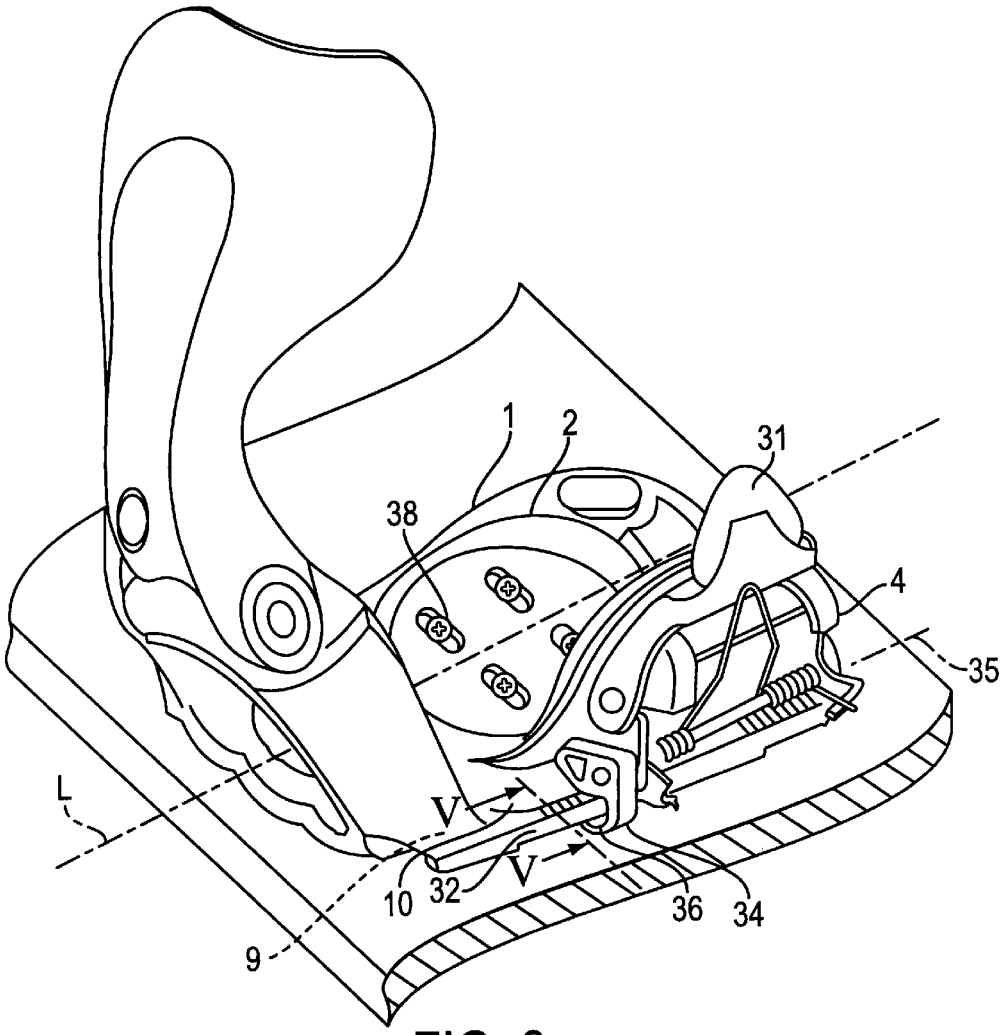
FIG. 3 is a rear perspective view of the retention device as assembled on a glide board.

As can be seen from FIGS. 1 and 3, the retention mechanism 4 is affixed to the plate 2. The retention means 4 is used to retain the boot 5 on the device in a detachable manner, by cooperating with an insert 30 of the boot 5.

The structure and functioning method of the retention mechanism 4 are explained in U.S. Pat. No. 6,050,589, the disclosure of which is hereby incorporated by reference thereto for this purpose, and is not be described detail here. The retention mechanism 4 enables the boot to further put on automatically by taking support with the foot towards the board 8, and a manual removal is ensured by action on a lever 31 of the retention mechanism 4.

Because the boot 5 is retained on the plate 2, and because the rear edge 13 is affixed to the base 1, the same tightening device for the disk 3 allows the device to be positioned on the board 8 and to wedge the edge 13 against the heel of the boot 5. An advantageous result thereof is that the adjustment operations of the device are made easier.

Figure 5:
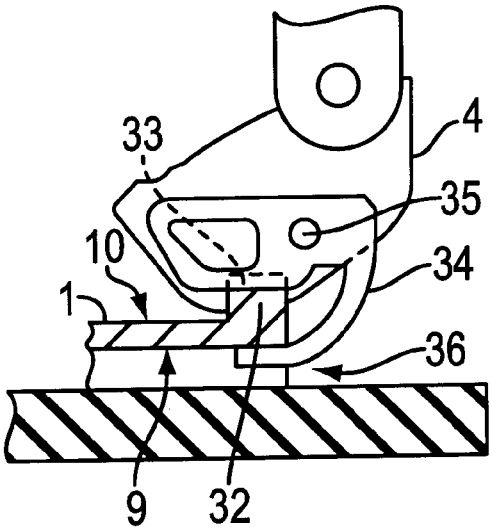
FIG. 5 is a cross-section taken along the line V—V of FIG. 3.

As shown in FIGS. 3 and 5, the base 1 has a lateral ridge 32 that projects along the surface 10, and the retention mechanism 4 has a groove 33 provided to cooperate with the ridge 32, so as to translationally guide the plate 2 with respect to the base 1. The ridge 32 and the groove 33 are oriented parallel to the longitudinal direction L. This arrangement enables the boot 5 to be aligned on the device.

As shown in FIG. 4, any relative displacement in the longitudinal direction L of the base 1 with respect to an assembly comprising the board 8, the plate 2, the disk 3 and the tightening screws of the disk 3 on the board 8, is limited by the contact of the boss 17 with the front end 28 or the rear end 29 of the opening 18 of the base 1. The maximum displacement amplitude 1 is clearly visible upon seeing the change in position of the retention mechanism 4, represented in dotted lines for reasons of ease.

In order to facilitate the manipulations even further, as seen better from FIG. 5, a positioning mechanism represented in the form of a cursor 34 and affixed to the retention mechanism 4, for example, along an axis 35, is shaped like a clip that permanently biases the base 1 and the plate 2 towards one another. In order to achieve this, the cursor has an elastic arm 36 that takes support on the lower surface 9 of the base 1. The cursor 34 enables the base 1 to be positioned with respect to the plate 2 during the adjustment manipulations of the device, such positioning being a result of the friction of the arm 36 along the surface 9. Thus, the device remains adjusted correctly, even if the tightening screws of the disk 3 are loosened.

The principle for adjusting the device is as follows. Initially, the tightening screws of the disk 3 are loosened slightly. Then, the user puts on the boot, and orients the foot in the position that suits him/her on the board 8, and brings the edge 13 in contact with the heel of the boot S. Then, all he/she needs to do is slip off the boot and tighten the tightening screws, and the device becomes ready to use.

Generally speaking, the device can be manufactured by means of any materials and according to any technique known to one skilled in the art. Specifically, the base 1, the edge 13 and the ridge 32 can be made all in one piece from an injected plastic material. The plate 2 and a part of the retention mechanism 4 can also be made all in one piece from a metallic alloy, such as an aluminum alloy.

The invention is not limited to the particular embodiment described herein, and has all technical equivalents that could be encompassed by the scope of the following claims.

In particular, it can be provided that the rear edge 13 and the collar 37 are obtained all in one piece. Other retention mechanisms for the boot 5 on the plate 2 can also be used. The number of screws used for tightening the disk 3 can vary, and a single screw could suffice. Finally, other structures ensuring the same functions could be envisioned to obtain the retention device.

What is claimed is:

1. A retention device for a boot on a glide board provided for the practice of snowboarding, the device comprising a base, a plate, a disk and at least one retention screw for the disk provided to be screwed into the board, the base having a rear support element provided to come into contact with the boot, a retention mechanism affixed to the plate allowing the boot to be retained on the device, the device extending along a longitudinal direction which is the longitudinal direction of the boot when the latter is retained on the device, and at least one translational guide mechanism for the plate with respect to the base along the longitudinal direction of the device.

2. A retention device according to claim 1, wherein the disk biases the plate and the base towards the board when the screw is screwed into the board, such that the plate and the base are immobilized simultaneously with respect to the board.

3. A retention device according to claim 1, wherein the translational guide mechanism is provided by the cooperation of at least one groove of the plate with at least one projecting ridge of the base, the groove and the ridge being oriented in parallel to the longitudinal direction of the device.

4. A retention device according to claim 1, wherein a positioning mechanism is provided to translationally position the plate with respect to the base in the longitudinal direction.

5. A retention device according to claim 4, wherein the positioning mechanism comprises a cursor that permanently biases the plate towards the base by a pinching effect.

6. A retention device according to claim 1, wherein the disk has a peripheral surface provided to position the plate with respect to the disk, the plate having a surface that is complementary to the surface of the disk.

7. A retention device according to claim 2, wherein the retention mechanism of the boot and the translational guide mechanism of the plate with respect to the base arc arranged in the vicinity of a lateral edge of the device.

8. An assembly comprising a board adapted for snowboarding, and a device for retaining a boot on the board according to claim 1.

9. A retention device for a boot on a glide board adapted for snowboarding, said device comprising:

a base having a rear support element positioned for engagement with a rear of the boot, said base being adapted to be supported upon the glide board, said base extending in a longitudinal direction, said longitudinal direction corresponding to a longitudinal direction of the boot supported on said base;

a plate supported upon said base;

a boot retention mechanism affixed to said plate for retaining the boot on the device;

a tightening device supported upon said plate, said tightening device being directly securable to the glide board for tightening said plate and said base to the glide board; and at least one translational guide mechanism for guiding said plate in translation with respect to said base along said longitudinal direction of said base.

10. A retention device according to claim 9, wherein:

said tightening device comprises a disk; and at least one screw is provided to extend through said disk and into the glide board.

11. A retention device according to claim 10, wherein:

said disk includes a plurality of oblong holes; and said at least one screw comprises a plurality of screws, each of said plurality of screws extending through a respective one of said oblong holes, said oblong holes providing adjustability of said disk, said plate, and said base with reset to the glide board independent of said translational guide mechanism.

12. A retention device according to claim 10, wherein:

said plate includes an upwardly open recess, and said disk is seated within said recess.

13. A retention device according to claim 9, wherein:

said disk has a peripheral surface to position said plate with respect to said disk, said plate having a surface complementary to said surface of said disk.

14. A retention device according to claim 9, wherein:

said translational guide mechanism comprises means for providing positional adjustment of said plate with respect to said base only in translation along said longitudinal direction.

15. A retention device according to claim 14, wherein:

said means for providing positional adjustment of said plate comprises a longitudinally extending oblong opening of said base.

16. A retention device according to claim 9, wherein:

said disk forces said plate and said base towards the glide board when said at least one screw is screwed into the glide board, whereby said plate and said base are simultaneously immobilized with respect to the glide board.

17. A retention device according to claim 9, wherein:

said translational guide mechanism comprises at least one groove of said plate and at least one projecting ridge of said base cooperating with said groove, said ridge and said groove being oriented parallel to said longitudinal direction of said base.

18. A retention device according to claim 9, further comprising:

a positioning mechanism to releasably secure said plate with respect to said base in a determinate longitudinally adjustable position with respect to said base.

19. A retention device according to claim 18, wherein:

said positioning mechanism comprises a cursor, said cursor permanently biasing said plate towards said base by a pinching effect.

20. A retention device according to claim 9, wherein:

said boot retention mechanism and said translational guide mechanism of said plate with respect to said base are arranged in the vicinity of a lateral edge of the device.

21. A retention device according to claim 9, wherein:

said rear support element extends longitudinally rearwardly and upwardly from said base for engagement with a rear of the boot.

22. A retention device according to claim 9, wherein:

said rear support element further comprises a rear edge portion in the form of an arc.

23. A retention device according to claim 22, further comprising:

a collar journalled with resect to said rear edge portion.

24. An assembly comprising:

a snowboard; and a retention device for retaining a boot on said snowboard, said device comprising:

a base having a rear support element positioned for engagement with a rear of the boot, said base being supported upon the glide board, said base extending in a longitudinal direction, said longitudinal direction corresponding to a longitudinal direction of the boot supported on said base;

a plate supported upon said base;

a boot retention mechanism affixed to said plate for retaining the boot on the device;

a tightening device supported upon said plate, said tightening device being directly secured to said snowboard for tightening said plate and said base to said snowboard; and at least one translational guide mechanism for guiding said plate in translation with respect to said base along said longitudinal direction of said base.

25. An assembly according to claim 24, wherein:

said tightening device comprises a disk; and at least one screw is provided to extend through said disk and into the glide board.

* * * * *